US005260180A

United States Patent [19]

Sahyun et al.

[11] Patent Number: 5,260,180

[45] Date of Patent: Nov. 9, 1993

[54] PHOTOTHERMOGRAPHIC IMAGING MEDIA EMPLOYING SILVER SALTS OF TETRAHYDROCARBYL BORATE ANIONS

[75] Inventors: Melville R. V. Sahyun, Maplewood, Minn.; Ranjan C. Patel, Little Hallingbury, England

[73] Assignee: Minnesota Mining and Manufacturing Company, St. Paul, Minn.

[21] Appl. No.: 939,131

[22] Filed: Sep. 2, 1992

[51] Int. Cl.[5] ..... G03C 1/00; G03C 1/08

[52] U.S. Cl. ..... 430/542; 430/495; 430/618; 430/620

[58] Field of Search ..... 430/620, 618, 542, 495

[56] References Cited

U.S. PATENT DOCUMENTS

| | | | |
|---|---|---|---|
| 3,457,075 | 7/1969 | Morgan et al. | 96/67 |
| 3,589,903 | 6/1971 | Birkeland | 96/67 |
| 3,716,366 | 2/1973 | Riester | 430/338 |
| 3,754,921 | 8/1973 | Riester | 430/338 |
| 4,208,478 | 6/1980 | Gardner et al. | 430/617 |
| 4,297,441 | 10/1981 | Kaneko et al. | 430/543 |
| 4,307,182 | 12/1981 | Dalzell et al. | 430/495 |
| 4,374,921 | 2/1983 | Frenchik | 430/338 |
| 4,865,942 | 9/1989 | Gottschalk et al. | 430/341 |
| 4,987,049 | 1/1991 | Kamamura et al. | 430/213 |

FOREIGN PATENT DOCUMENTS

| | | | |
|---|---|---|---|
| 0468465 | 1/1992 | European Pat. Off. | 430/495 |

*Primary Examiner*—Charles L. Bowers, Jr.
*Assistant Examiner*—James W. Pasterczyk
*Attorney, Agent, or Firm*—Gary L. Griswold; Walter N. Kirn; Mark A. Litman

[57] ABSTRACT

Thermally imageable compositions, comprising a silver salt of an organic acid, a reducing agent, and, optionally, an activator, coated together in a suitable polymeric binder, can be rendered photoimageable by the addition of a salt of a tetrahydrocarbylborate anion.

13 Claims, No Drawings

PHOTOTHERMOGRAPHIC IMAGING MEDIA EMPLOYING SILVER SALTS OF TETRAHYDROCARBYL BORATE ANIONS

BACKGROUND OF THE INVENTION

1. Field of the Invention

The invention relates to photothermographic materials that are light sensitive, and in particular, materials free of silver halide which are based on silver soaps that are thermally developable.

2. Information Disclosure Statement

Photothermographic imaging materials based on the chemistry of silver salts of organic acids have been long known. In the earliest examples (Talbot, U.S. Pat. No. 5,171 (1847)) the intrinsic light sensitivity of the silver salt of the acid, e.g., silver acetate, was used to create the latent image, amplified by thermolysis of the silver salt. Later investigators based fundamentally similar systems on silver oxalate (Sheppard and Vanselow, U.S. Pat. No. 1,976,302 (1934); U.S. Pat. No. 2,095,839 (1937); U.S. Pat. No. 2,139,242 (1938); Suchow and Herah, U.S. Pat. No. 2,700,610 (1955)). The early history of photothermography has been reviewed by Klosterboer (in *Neblette's Imaging Processes and Materials*, Sturge, Walworth and Shepp, eds. (New York, van Nostrand Reinhold, 1989), chap. 9).

Materials with useful photographic speeds have, however, up until now, required the use of silver halide as a light sensitive component (Sorensen and Shepard, U.S. Pat. No. 3,1522,904 (1964; reissued 1969); Yutzy, U.S. Pat. No. 3,392,020 (1968); Morgan and Shely, U.S. Pat. No. 3,457,075 (1969)). A commonly perceived drawback of these compositions is the persistence of photochemical activity of the silver halide after thermal processing of the imaging material. This leads to instability of the processed image on the medium when exposed to light (Kurttila, J. Micrographics, 10: 113 (1977)). It is one purpose of this invention to eliminate the use of silver halide in photothermographic imaging media.

Relatively little literature exists on silver salts of tetrahydrocarbylborate anions (herein "silver organoborates"). Silver tetraphenylborate is easy to prepare by mixing solutions of silver tetrafluoroborate and sodium tetraphenylborate, both in methanol; the product precipitates and can be collected and dried in the usual manner. It is noticeably light sensitive.

It is relevant to the present invention that when a silver iodide dispersion (ca. 450 Å particle size) in 2-butanone is treated with excess tetrabutylammonium n-butyl-triphenylborate, the dispersion shortly ceases to exhibit a Tyndall effect (characteristic of the presence of colloidal particles), and the exciton absorption of hexagonal AgI at 422 nm also disappears from the absorption spectrum; the solution in fact becomes transparent beyond 320 nm. These observations indicate dissolution of the AgI by metathetical conversion to the organoborate salt, which happens to be soluble in 2-butanone.

SUMMARY OF THE INVENTION

Thermally imageable compositions, comprising a silver salt of an organic acid, e.g. silver behenate, a reducing agent, e.g. leuco dye (Frenchik, U.S. Pat. No. 4,374,921 (1983)) or hindered phenolic antioxidant (U.S. Pat. No. 3,589,903), and, optionally, an activator or toner, e.g. phthalic acid or phthalazinone (Klosterboer, loc. cit.), coated together in a suitable polymeric binder, e.g., polyvinylbutyral, can be rendered photoimageable by the addition of a salt of a tetrahydrocarbylborate anion. It is believed that in the presence of the tetrahydrocarbylborate anion, a portion of the silver salt of the organic acid converts to a silver organoborate salt.

Optionally, the imaging compositions of the invention may comprise spectral sensitizing dyes, toners, stabilizers, and antifoggants, as in the case of imaging compositions of the prior art which utilize silver halides as the light sensitive component.

All the components of the composition may be coated as one layer on a suitable support, or they may be divided up among a plurality of layers, to be brought together by thermal diffusion under conditions of development.

When the image-forming compositions are spectrally sensitized, more than one imaging layer(s) of the invention may be coated, superimposed on one another, each sensitive to a different region of the spectrum, as is well-known in the fabrication of color photographic films and papers.

It is within the scope of our invention that imaging elements of the invention may be combined with imaging elements of the prior art, e.g. as separate layers on a common support, each responding to different regions of the electromagnetic spectrum, and/or each yielding images on exposure and development exhibiting different visual characteristics, e.g. color.

The visible image, produced by exposure and thermal development of the compositions of the invention, may comprise either a metallic silver deposit formed by image-wise reduction of the silver salt of the organic acid, or an organic dyestuff formed image-wise by oxidation of a dye-precursor which also is capable of functioning as a reducing agent for silver(I), or a combination thereof.

In comparison with compositions rendered light imageable by partial halidization of the silver soap (e.g., U.S. Pat. No. 3,457,075), compositions of this invention may exhibit improved stability of the final processed image to light, increased efficiency of spectral sensitization, and improved color purity of dye images formed by image-wise oxidation of the leuco dye reducing agent. Notably, these imaging characteristics are obtained without introduction of toxic mercury compounds, as is common in silver halide containing photothermographic imaging media (Birkeland, U.S. Pat. No. 3,589,903).

DETAILED DESCRIPTION OF THE INVENTION

Organo Borates

Organoborate salts for use in the present invention have a nucleus of general formula (I):

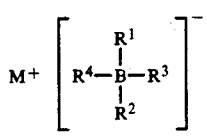

(I)

in which;

each of $R^1$ to $R^4$ independently represents a halogen atom, a cyano group, an alkyl group comprising up to 30 carbon atoms, preferably up to 10 carbon atoms, an alkenyl group comprising up to 30 carbon atoms, preferably up to 10 carbon atoms, an alkynyl group comprising up to 30 carbon atoms, preferably up to 10 carbon atoms, an aryl group comprising up to 14 carbon atoms, preferably up to 10 carbon atoms, an aralkyl group comprising up to 14 carbon atoms, preferably up to 10 carbon atoms, an alkoxy group comprising up to 30 carbon atoms, preferably up to 10 carbon atoms; an aryloxy group comprising up to 14 carbon atoms, preferably up to 10 carbon atoms, a carbocyclic ring nucleus, generally comprising from 5 to 8 carbon atoms, a carbocyclic fused ring nucleus, generally comprising up to 14 carbon atoms, a heterocyclic ring nucleus, generally comprising from 5 to 8 ring atoms, a heterocyclic fused ring nucleus, generally comprising up to 14 ring atoms, which ring atoms are selected from C, N, O, S and Se, each of which groups, ring nuclei and fused ring nuclei may optionally possess one or more substituents selected from alkyl groups comprising up to 5 carbon atoms, alkenyl groups comprising up to 5 carbon atoms, aryl groups comprising up to 10 carbon atoms, a nitro group, a cyano group and halogen atoms; alkoxy of up to 10 carbon atoms, and amino; and $M^+$ is a cation.

Examples of suitable alkyl groups represented by $R^1$ to $R^4$ include: methyl, ethyl, propyl, isopropyl, butyl, isobutyl, t-butyl, pentyl, isopentyl, hexyl, octyl, trifluoromethyl, etc.

Examples of suitable alkenyl groups include ethenyl, propenyl, butenyl, pentenyl, toxenyl, heptenyl, octenyl, docenyl, prenyl and the like.

Examples of suitable alkynyl groups include ethynyl, propynyl, butynyl, pentynyl, hexynyl, heptynyl, and substituted alkynyl e.g., phenylethynyl, etc.

Examples of suitable carbocyclic ring nuclei include cyclopentyl, cyclohexyl, cycloheptyl, cyclooctyl and the like.

Examples of suitable aryl groups include phenyl, naphthyl, fluorophenyl, chlorophenyl, dichlorophenyl, tolyl, xylyl, N,N-dimethylaminophenyl, chloronaphthyl, methoxynaphthyl, diphenylaminophenyl, etc.

Examples of suitable alkoxy groups include methoxy, ethoxy, propoxyl, butoxyl, isopropoxy, 2-methoxyethyloxy, 2-ethoxyethyloxy and the like.

Examples of suitable aryloxy groups include phenoxyl, naphthoxyl, benzodioxy, p-tolyloxy etc.

Examples of suitable aralkyl groups include benzyl, α-naphthylmethyl, β-naphthylmethyl, p-chlorobenzyl and the like.

Examples of suitable heterocyclic ring and fused ring nuclei include pyridyl, quinolyl, lepidyl, methylpyridyl, furyl, thienyl, indolyl, pyrrolyl, carbozolyl, N-ethylcarbazolyl, etc.

$M^+$ may comprise any suitable cation including metal ions, e.g., $Ag^+$, $Cd^{2+}$, $Cu^+$, $Pb^+$, $Pb^{2+}$, $Sn'^+$, $Zn^{2+}$, etc., although non-acidic cations, particularly alkali metal ions, e.g., $Li^+$, $Na^+$, $K^+$, etc., and compounds of formula $N^+(R^5)_4$ in which each $R^5$ independently represents an alkyl group comprising up to 5 carbon atoms or an aryl group comprising up to 10 carbon atoms, are preferred both for reasons of solubility and because organoborate salts tend to be invariably acid-labile. Other suitable cations include cationic dyes, in particular cyanine dyes.

Specific examples of the borate anion are tetramethylborate, tetraethylborate, tetrabutylborate, triisobutylmethylborate, di-t-butyldibutylborate, trifluoromethyltrifluoroborate, tetra-n-butylborate, tetraphenylborate, tetra-p-chlorophenylborate, tetraaniseborate, triphenylbutoxyborate, trianisebutylborate, trianisebenzyloxyborate, triphenylmethylborate, triphenylethylborate, triphenylpropylborate, triphenyl-n-butylborate, triphenylhexylborate, trimesitylbutylborate, tritolylisopropylborate, triphenylbenzylborate, tetraphenylborate, tetrabenzylborate, triphenylbenzyborate, tetraphenylborate, tetrabenzylborate, triphenylphenethylborate, triphenyl-p-chlorobenzylborate, trimethallylphenylborate, tricyclohexylbutylborate, tri(phenylethyl)butylborate, di(α-naphthyl)-dipropylborate, etc.

Preferred organoborate salts for use in the present invention comprise a monoalkyltriarylborate anion, e.g., tetrabutyl ammonium n-butyltriphenylborate, or a tetraarylborate anion, e.g., sodium tetraphenylborate. Organoborate salts comprising a tetraaryl borate anion are most preferred. Organoborate salts comprising two or more alkyl groups bound to boron exhibit markedly reduced stability.

Organoborate salts are known and may be synthesized by methods such as those described by C. Wittig in U.S. Pat. No. 2,853,525; by G. Wittig in German Patent No. 883147; by Wittig and Henry in *Chem. Ber.*, 88, 962 (1955); by Domico in *J. Org. Chem.*, 29, 1971 (1964); *Anal. Chem. Act.*, 32, 376 (1965); by Hoerx and Richter in *Journal fur Praktische Chemie*, 26, 15 (1964); by Wittig et al. in *Annalen der Chemie*, 563, 110 (1949); and by Kropp et al. in *Journal of the American Chemical Society*, 113, 2155 (1991).

Silver Soaps

The reducible silver source for the compositions of this invention may comprise silver salts of organic acids, preferably long chain (from 10 to 30, preferably 15 to 28 carbon atoms) fatty carboxylic acids. Complexes of organic or inorganic silver salts in which the ligand has a gross stability constant for silver ion of between 4.0 and 10.0 are also useful (e.g. U.S. Pat. No. 4,260,677). Examples of suitable silver salts are disclosed in Research Disclosure Nos. 17029 and 29963. The preferred silver salt is silver behenate. The silver source generally constitutes from about 5 to 70, preferably from 7 to 45 percent by weight of the imaging layer. The presence of a second layer in a two-layer construction does not unduly affect the amount of the silver source used.

REDUCING AGENTS

The reducing agent for silver ions may comprise a conventional photographic developer such as phenidone, hydroquinones and catechol, although hindered phenols are preferred for forming black and white images. The reducing agent should be present as 1 to 10 percent by weight of the imaging layer. In a two-layer construction, if the reducing agent is in the second layer, slightly higher proportions, of from 2 to 15 percent, tend to be more desirable. Toners such as phthalazinone, phthalic acid, and both phthalazine and phthalic acid, and others known in the art, are not essential to the construction, but are highly desirable. These materials may be present, for example, in amounts of from 0.2 to 12 percent by dry weight of the image producing layer(s).

The developer or the toner and developer together, must be capable of interacting with and reducing the organic silver salt to silver in the exposed regions of the element during thermal processing. Examples of suitable toners and developers are disclosed in U.S. Pat.

Nos. 3,770,448, 3,773,512 and 3,893,863 and Research Disclosure Nos. 17029 and 29963. The preferred toners are phthalazinone (PAZ),

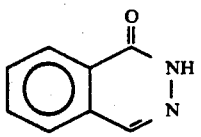

phthalic acid, and lower alkyl-substituted o-phthalic acids, or phthalazine (PHZ)

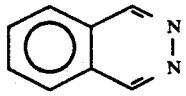

The preferred developer for forming black and white images is,

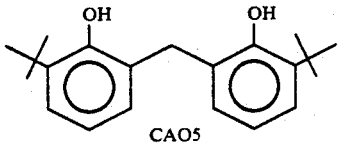

CAO5

Leuco dyes may be used to reduce the actinically exposed areas of the sensitive layer to form monochromatically colored images. Suitable compounds have been disclosed in U.S. Pat. No. 4,460,861. Two examples of such effective leuco dyes are:

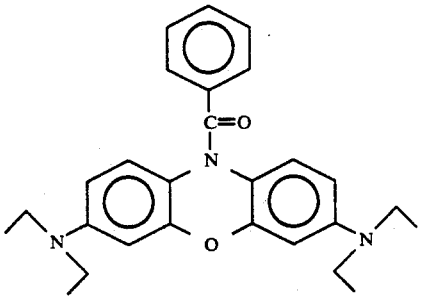

Pergascript Turquoise

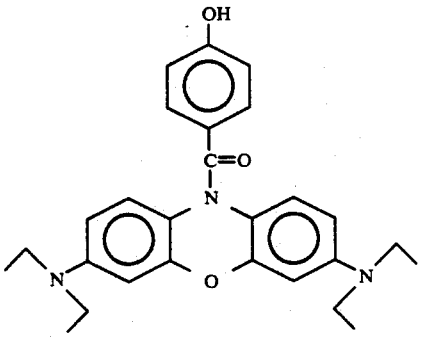

DG

Another example is ethylketazine magenta. A class of leuco dyes having the following general structure would be expected to be valuable as reducing agents,

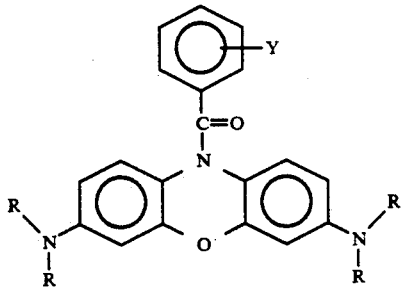

where

R represents substituents independently selected from alkyl and substituted alkyl, Y is one or more sustituents of the ring chosen from alkyl, alkoxy, hydroxy, halogen, and thioalkyls, as described in U.S. Pat. No. 4,460,861. The Y substituted phenyl group may also have a para-hydroxy group thereon.

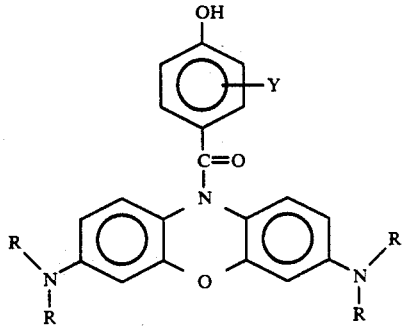

Spectral Sensitzing Dyes

Sensitizing dyes capable of spectral sensitization of normal silver halide or dry silver compositions are applicable to the compositions of this invention. Dyes of the cyanine class are preferred. The dye SD-1 is an example of suitable spectral sensitizers.

SD-1

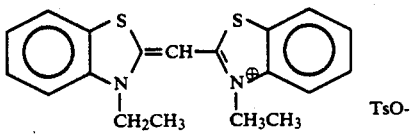

Binders

The photothermographic chemistry of the element is typically applied to the support in a binder. A wide range of binders may be employed in the various layers of the photothermographic element. Suitable binders are transparent or translucent, are generally colorless and include natural polymers, synthetic resins, polymers and copolymers and other film forming media such as: gelatin, gum arabic, poly(vinyl alcohol), hydroxyethyl cellulose, cellulose acetate, cellulose acetate butyrate, poly(vinyl pyrrolidine), casein, starch, poly(acrylate), poly(methylmethacrylate), poly(vinyl chloride), poly(methacrylate), poly(styrene-maleic anhydride), poly(styrene-acrylonitrile), poly(styrene-butadiene), poly(vinyl acetals), poly(vinyl formal), poly(vinyl butyral), poly(esters), poly(urethanes), phenoxy resins, poly(vinylidene chloride), poly(epoxides), poly(carbonates), poly(vinyl acetate), cellulose esters, poly(amides), copolymers of these materials, and other similar solvent-soluble binders. The binders may range from thermoplastic to highly crosslinked, and may be coated from aqueous or organic solvents or an emulsion. Poly(vinyl butyral) is the preferred binder for practice of the invention.

Supports

Photothermographic elements in accordance with the invention are prepared by simply coating a suitable support or substrate with the one or more binder layers containing the necessary photothermographic chemistry. Each layer is generally coated from a suitable solvent using techniques known in the art. Exemplary supports include materials such as paper, polyethylene-coated paper, polypropylene-coated paper, parchment, cloth and the like; sheets and foils of such metals as aluminum, copper, magnesium and zinc; glass and glass coated with such metals as chromium, chromium alloys, steel, silver, gold and platinum; synthetic polymeric materials such as poly(alkyl methacrylates), e.g., poly(methyl methacrylate), poly(esters), e.g., poly(ethylene terephthalate), poly(vinylacetals), poly(amides), e.g., nylon, cellulose esters, e.g., cellulose nitrate, cellulose acetates, cellulose acetate propionate, cellulose acetate butyrate, and the like.

Self Supporting Films

It is not essential for the photothermographic elements of the invention to have a separate support since each binder layer(s) containing the photothermographic chemistry may be cast to form a self-supporting film.

EXAMPLES

The practice of the invention is further illustrated by the following Examples.

EXAMPLES 1

A silver behenate pre-mix was prepared by diluting 11 g of a silver behenate half-soap homogenate (10 wt. % 1:1 silver behenate-behenic acid dispersed in a toluene-ethanol mixture), with 40 g of a solution of polyvinylbutyral (6 wt. % Sekusui BX-L, by Sekusui Chemical Co., Japan) in absolute ethanol. Aliquots (13.5 g) of this pre-mix were sensitized by addition of 0.5 ml 0.01M mercuric bromide (HG), 0.5 ml 0.01M anhydrous zinc dibromide (ZN, Fisher Certified ®, Fisher Scientific, Fair Lawn, N.J.) or 1.0 ml sodium tetraphenylborate (NA, Aldrich Chemical Co., Milwaukee, Wis.), all in methanol, followed by 15 min ultrasonication at room temperature in a Branson ultrasonic cleaning bath by Branson Cleaning Equipment Co., Shelton, Conn.. To each aliquot was then added 0.1 g Pergascript Turquoise in 1 ml toluene and, immediately before coating, 1 ml 0.4M phthalic acid in methanol. Portions of each aliquot were coated under photographic safelight on a white-pigmented polyester film base using a 40-gauge wire-wound rod. The coatings were air dried, first at room temperature and then for 2 minutes in an oven at 70° C.

Samples of the coating were exposed to a near-UV rich light source (3M Model 172 microfiche duplicator) through a step tablet for 2 seconds (samples HG and ZN) or 20 seconds (sample NA) and subsequently developed 8 seconds at 140.5° C. on a heated drum. Reflection densitometric data (recorded with use of a standard reference filter) in Table Ia demonstrate that a useful light sensitive imaging medium can be constructed according to the invention without recourse to incorporation of silver halide therein.

TABLE Ia. Densitometric Responses of Coatings of Example 1.

TABLE Ia

Densitometric Responses of Coatings of Example 1.

| Coating | $D_{min}$ | $D_{max}$ | Contrast | Speed[a] |
|---|---|---|---|---|
| ZN | 0.23 | 2.32 | 2.9 | 10 steps |
| HG | 0.14 | 2.18 | 2.7 | 14 steps |
| NA | 0.22 | 1.70 | 1.8 | 10 steps |

[a]Number of exposure steps required to obtain a reflection density at least 0.6 above base plus fog.

Post-processing print stability of the samples was evaluated by placing similarly exposed and developed samples face-down on a fluorescent light table (Lucentview ®, manufactured by Buckingham Graphics, Chicago, Ill.) for 6 hrs. Reflection $D_{min}$ was monitored hourly with the results shown in Table Ib.

TABLE Ib

Print Stability of Images Formed in Media of Example 1.

| | Sample: | HG | ZN | NA |
|---|---|---|---|---|
| $D_{min}$@ t = | 0 | 0.11 | 0.18 | 0.20 |
| | 1 hr | 0.23 | 0.28 | 0.26 |
| | 2 | 0.29 | 0.31 | 0.27 |
| | 3 | 0.33 | 0.38 | 0.32 |
| | 4 | 0.34 | 0.38 | 0.33 |
| | 5 | 0.39 | 0.40 | 0.34 |
| | 6 | 0.43 | 0.45 | 0.37 |
| $d(D_{min})/dt$ | ($hr^{-1}$) | 0.037 | 0.032 | 0.022 |

These data show that the rate of background staining under relatively intense illumination, measured as the least-squares rate of change in $D_{min}$, $d(D_{min})/dt$, is substantially less for the organoborate sensitized sample than for the photothermographic coatings of the prior art (samples HG and ZN).

EXAMPLE 2

Aliquots (13 g) of the silver behenate pre-mix of Example 1 were treated with 0.5 ml 0.01M mercuric bromide (HG), 0.5 ml 0.01M sodium tetraphenylborate (NA), or 0.5 ml 0.01M tetraethylammonium N-butyltriphenylborate (BU) and sonicated for 15 minutes. The N-butyl-triphenylborate salt was prepared by a modification of the procedure of Wittig and Herwig (*Chem. Ber.* 88, 962 (1955)) for the addition of tolyl lithium to triarylboron compounds, in which n-butyl lithium was substituted for the tolyl lithium. To each aliquot was then added 2 ml of the p-hydroxybenzoyl analog of Pergascript Turquoise (DG) 6 wt. % in 2:1 toluene-methanol solution, and 3 ml of a saturated solution (ca. 5 wt. %) of phthalazinone (PAZ, Aldrich) in tetrahydrofuran. Each aliquot was coated and dried as in Example 1.

Samples of each coating were exposed for 20 sec as in Example 1 (HG-coatings were exposed 2 sec); development was for 8 sec at the temperature, T, indicated in Table IIa. As in Table Ia, speeds are reported as the step tablet step number required to yield a reflection optical density of >0.6 above $D_{min}$.

From these results it can be seen that useful photoimageable compositions result with PAZ-activation of development, as well as with acid activation, as in Example 1. The data also show that an alkyltriarylborate salt, which yields a silver salt soluble in common organic solvents, is useful, as well as the tetraarylborate salt, as used in Example 1, which forms a highly insoluble silver salt, in practice of the invention.

TABLE IIa

Sensitometric Characteristics of Organoborate Sensitized Dry Silver Media.

| Response @ T(°F.) | | BU | HG | NA |
|---|---|---|---|---|
| $D_{min}$ | 265 | 0.26 | 0.11 | 0.18 |
| $D_{max}$ | " | 1.35 | 1.26 | 0.92 |
| Speed | " | 7 | 7 | 5 |
| $D_{min}$ | 275 | 0.50 | 0.14 | 0.24 |
| $D_{max}$ | " | 2.36 | 2.06 | 1.84 |
| Speed | " | 9 | 8 | 8 |
| $D_{min}$ | 285 | 2.00 | 0.18 | 0.82 |
| $D_{max}$ | " | >2.5 | >2.5 | >2.5 |
| Speed | " | n/a | 11 | 11 |

The light stability of images formed in the BU-material on development at 265° F. and in the NA- and HG-materials on development at 275° F. were compared in a similar light box ageing test as described in Example 1. The results are summarized in Table IIb and demonstrate that replacement of silver halide with a silver organoborate salt as the light sensitive component in a phthalazinone-activated photothermographic image material essentially removes post-processing background instability.

TABLE IIb

Light Stability of Images Formed in Media of Example 2.

| | Sample: | BU | HG | NA |
|---|---|---|---|---|
| $D_{min}$ @ t = | 0 | 0.28 | 0.14 | 0.28 |
| | 1 hr | 0.29 | 0.27 | 0.28 |
| | 2.5 | 0.30 | 0.36 | 0.29 |
| | 3.5 | 0.32 | 0.41 | 0.31 |
| | 4.75 | 0.33 | 0.44 | 0.32 |
| $d(D_{min})/dt$ | ($hr^{-1}$) | 0.011 | 0.061 | 0.009 |

EXAMPLE 3

Two 27 g aliquots of the silver behenate pre-mix as in Example 1 were prepared. One was sensitized with 1 ml 0.01M $ZnBr_2$ (ZN); the other was sensitized with 1 ml 0.01M sodium tetraphenylborate (B). Each aliquot was sonicated for 15 minutes and then further divided into four portions of 6.5 g each. To each of these portions was then added none, 0.125 ml, 0.25 ml, or 0.5 ml of a solution $5\times10^{-3}$M sensitizing dye SD-1 ($\lambda_{max}$=420 nm) in methanol. The portions were then sonicated an additional 15 minutes.

Thereafter, to each portion was added 0.05 g Pergascript Turquoise dissolved in a minimum volume of toluene and 0.5 ml of 0.4M phthalic acid in methanol. They were coated immediately by means of a knife coater, 0.003 inches (0.076 mm) wet on the same pigmented polyethylene terephthalate support as used in Examples 1 and 2, and dried for 2 min. in an oven at 80° C.

For sensitometric evaluation, samples of each of the eight coatings were exposed for 2 seconds through a step tablet on the exposure device of Example 1, then processed for 8 seconds at 275° F. on a heated drum. The reflection optical densities of the individual steps were read through a standard red filter to provide characteristic curves of the cyan images. Speed was read from the curves as the step number corresponding to a reflection optical density >0.6 above background; contrast was read as the slope, dD/d(log E), of the tangent at the steepest portion of the curve. The color purity, CP, of the cyan images at $D_{max}$ was also estimated;

$$CP=D_R/(D_R+D_G+D_B)$$

and $D_R$, $D_G$ and $D_B$ represent reflection optical densities read through red, green, and blue filters, respectively. Data are listed in Table III.

TABLE IIII

Sensitometric Responses of Photothermographic Media of Example 3.

| Sensitizer | ml SD-1 | $D_{min}$ | $D_{max}$ | Speed | Contrast | CP |
|---|---|---|---|---|---|---|
| $NaPh_4B$ | 0 | 0.25 | 1.41 | 6 | 0.7 | — |
| " | 0.125 | 0.54 | 1.94 | 15.5 | 1.3 | — |
| " | 0.25 | 0.33 | 1.80 | 15.5 | 1.8 | 0.56 |
| " | 0.50 | 0.46 | 1.76 | 15.5 | 1.9 | — |
| $ZnBr_2$ | 0 | 0.27 | 2.35 | 12 | 2.2 | — |
| " | 0.125 | 0.19 | 2.30 | 14 | 2.7 | — |
| " | 0.25 | 0.21 | 2.21 | 16.5 | 4 | 0.42 |
| " | 0.50 | 0.19 | 2.32 | 17 | 3.7 | — |

These data demonstrate that photothermographic media in which the light sensitive component is produced in situ by introduction of an organoborate salt are as amenable to spectral sensitization as those in which a silver halide forms the light sensitive component. When formed and spectrally sensitized in this manner, the organoborate-based imaging media are capable of photographic speeds comparable to media of the prior art. The color purity data also show that better color quality is achievable in compositions of the present invention. For comparison, a coating of a solid polymer solution of pure Basic Blue 3 dye, the oxidation product of Pergascript Turquoise, on a white paper support exhibited a CP of 0.73.

Stability of the processed images to light was evaluated in an experiment similar to that described in Example 1. Under the same conditions, a sodium tetraphenylborate sensitized sample incorporating 0.25 ml SD-1 per 6.5 g aliquot of pre-mix exhibited a least-squares change in background density, $d(D_{min})/dt$ of 0.034 $hr^{-1}$, and a total change in background optical density over the course of the 6 hr experiment, $\Delta D_{min}$, of 0.21. By comparison, the zinc bromide sensitized sample comprising the same level of SD-1 exhibited $d(D_{min})/dt$ of 0.052 $hr^{-1}$ and $\Delta D_{min}$, of 0.39. This result shows that incorporation of spectral sensitizing dye into the formulation does not remove the improvement in image stability demonstrated in Example 1.

EXAMPLE 4

To 6.5 g portions of the pre-mix of Example 1 were added 0.125 ml, 0.25 ml, and 0.5 ml, respectively, of a sodium tetraphenylborate solution 0.02M in methanol. On the molar equivalent basis, these additions correspond to 1.4, 2.8 and 5.5% of the silver present. The dispersions were sonicated for 15 minutes; Pergascript Turquoise and phthalic acid were added as in Example 3, and the resulting solutions were coated and dried as in Example 3. For sensitometric evaluation, samples of the resulting coatings were exposed for 20 seconds as in Example 1 and developed for 8 seconds at 275° F. on a heated drum. Results of reflection densitometry on the developed images are reported in Table IV.

TABLE IV

| Sensitometry of Photothermographic Coatings of Example 4. | | | | |
|---|---|---|---|---|
| $[NaPh_4B]^a$ | $D_{min}$ | $D_{max}$ | Speed | Contrast |
| 1.4% | 0.38 | 2.20 | step 8 | 2.8 |
| 2.8% | 0.33 | 2.15 | step 8.5 | 2.8 |
| 5.5% | 0.33 | 2.01 | step 9 | 2.8 |

[a]per mole silver, as silver behenate.

These results demonstrate that between 0.01 and 0.1 molar equivalent organoborate anion per equivalent silver provides useful speed and contrast for photothermographic imaging. By contrast attempted formulation of an imaging composition, as above, with 11 mol % sodium tetraphenylborate yielded a coating which, on exposure and development as above, exhibited a reflection $D_{max}$ of only 0.83, indicative of the undesirability of converting too much of the silver behenate to the organoborate salt.

EXAMPLE 5

Silver behenate full-soap (307.5 g) was dispersed in 2-butanone (1634 g) and toluene (545 g) containing polyvinylbutyral (Butvar® B-76,Monsanto Chemical Corp., St. Louis, Mo.) to provide full-soap dispersion. CAO-5 is a hindered phenolic antioxidant (Catalin Antioxidant, obtained from Shell Chemical Co.) commonly used as a reducing agent in photothermographic compositions of the prior art. PAZ (2-phthalazinone) and sodium tetraphenylborate were obtained from Aldrich Chemical Co. (Milwaukee, Wis.) and used as received. AF-1 (2-tribromomethyl-6,7- dimethyl-4-quinazoline) was synthesized according to standard procedures. The following two layer coating was made on 100 μm unsubbed transparent polyethylene terephthalate film base.

| First Trip | |
|---|---|
| Silver behenate full-soap dispersion | 10 g |
| Cellulose acetate butyrate 381-20 | 1 g |
| 2-butanone | 5 g |
| Methanol | 5 g |
| Sodium tetraphenylborate | x g |
| AF-1 (antifoggant) | 50 mg |

The composition, made under red safelight conditions, was coated with a knife coater, 4 mil (0.1 mm) wet, and dried for 1 hour at 30° C.

| Second Trip | |
|---|---|
| Cellulose acetate butyrate 381-20 | 1 g |
| 2-butanone | 5 g |
| methanol | 5 g |
| CAO-5 | 0.3 g |
| PAZ | 0.1 g |

This mixture was coated over the first trip at 3 mil wet and dried for 1 hour at 30° C.

Strips of the coating, 5×15 cm, were cut and lengthwise half exposed to 0.1, 10, 50 or 100 units exposure using a Parker Graphics 6 KW metal halide light source. Each strip was then cut horizontally into 2.5×5 cm sections. Each section was then heated at various development temperatures for 10 seconds to determine optimum development temperature, which was found to be 130° C. Table V records exposed (E) and unexposed (UE) transmission optical densities obtained under these conditions of exposure and development for various levels, x, of sodium tetraphenylborate.

TABLE V

| Developed Densities in Coatings of Example 5. | | | | | | | | | |
|---|---|---|---|---|---|---|---|---|---|
| | | Exposure: | | | | | | | |
| | | 0.1 | | 10 | | 50 | | 100 units | |
| Coating | x (g) | UE | E | UE | E | UE | E | UE | E |
| 1 | 0 | 0.08 | 0.08 | 0.08 | 0.18 | 0.13 | 0.20 | 0.13 | 0.36 |
| 2 | 0.004 | 0.10 | 0.10 | 0.11 | 0.12 | 0.11 | 0.08 | 0.12 | 0.08 |
| 3 | 0.05 | 0.21 | 0.22 | 0.24 | 0.38 | 0.42 | 0.31 | 0.52 | 0.37 |
| 4 | 0.5 | Considerable crystallization; poor coating | | | | | | | |

This example shows that at 5 wt. % with respect to silver behenate a negative image may be obtained at an order of magnitude less exposure than required by the control coating. It also illustrates the utility of conventional reducing agents of the prior art, as well as an optional antifoggant additive, in compositions of the invention. Note that at the highest level of exposure, a positive image forms. This requires the presence of both the organoborate salt and the AF-1.

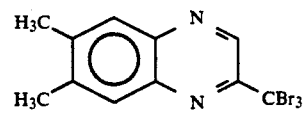

AF-1

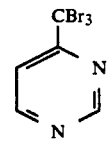

AF-2

EXAMPLE 6

A silver pre-mix was prepared as in Example 1. To a 25.5 g portion was added 1.0 ml 0.10M sodium tetraphenylborate in methanol. The mixture was ultrasonicated for 15 minutes. To this mixture were then added 0.15 g magenta ethylkatazine leuco dye (EK as described in U.S. Pat. No. 4,374,421) and 0.18 g PAZ, both dissolved in a solvent mixture comprising 8.5 ml tetrahydrofuran and 2.5 ml methanol, and 0.5 ml of a solution $5\times10^{-3}$M SD-1 in methanol. This mixture was, in turn, divided into two aliquots to which were added 0.01 g and 0.05 g of the antifoggant 4-tribromomethylpyrimidine (AF-2).

Both portions were knife coated 3 mil (0.076 mm) wet on the white-pigmented polyester film base (as used in Examples 1–4) and dried for 2 minutes at 70° C. A pair of control coatings were similarly prepared, which differed from the above only in that 1.0 ml 0.1M $ZnBr_2$ was substituted for the sodium tetraphenylborate solution. Samples of all the coatings were exposed for 2 seconds on the microfiche duplicator used in Example 1 through a step tablet and developed for 8 seconds at the temperatures indicated in Table VI, to yield magenta dye images. Sensitometric characteristics of the samples are also reported in the Table, based on reflection optical densities measured through a green filter.

TABLE VI

| Sensitometric responses of magenta monochromes coatings. | | | | | | |
|---|---|---|---|---|---|---|
| Sensitization | AF-2 | T (dev) | $D_{min}$ | $D_{max}$ | Speed[a] | Contrast |
| $NaPh_4B$ | 0.01 g | 275° F. | 0.12 | 0.76 | 6 | 0.4 |
| " | " | 285 | 0.15 | 1.17 | 11.5 | 0.8 |
| " | " | 295 | 0.23 | 1.25 | 10 | 0.6 |
| $NaPh_4B$ | 0.05 g | 275 | no image | | | |
| " | " | 285 | weak image | | | |
| " | " | 295 | 0.12 | 0.44 | — | — |

TABLE VI-continued

Sensitometric responses of magenta monochromes coatings.

| Sensitization | AF-2 | T (dev) | $D_{min}$ | $D_{max}$ | Speed[a] | Contrast |
|---|---|---|---|---|---|---|
| $ZnBr_2$ | 0.01 g | 275 | 0.12 | 0.78 | 7 | 0.45 |
| " | " | 285 | 0.16 | 1.09 | 11 | 1.0 |
| " | " | 295 | 0.16 | 1.15 | 11.5 | 0.85 |
| $ZnBr_2$ | 0.05 g | 275 | | weak image | | |
| " | " | 285 | 0.13 | 0.87 | 2 | — |
| " | " | 296 | 0.16 | 1.05 | 4 | — |

[a]Step number corresponding to a density of 0.6 above $D_{min}$.

This example teaches that magenta dye images can be made by the process of the invention. It also illustrates the use of an antifoggant (AF-2); in this case, attempts to produce samples without the antifoggant yielded coatings which exhibited no useful discrimination in developed dye image density between exposed and unexposed areas. The example also shows that use of an excess of antifoggant leads to strong desensitization of the photothermographic response, as would be expected by those skilled in the art.

EXAMPLE 7

A silver pre-mix was prepared as described in Example 1. To each of three 6.5 g aliquots was added 0.5 ml of SD-1 (0.005M in methanol) and 1.0 ml of an appropriate organoborate salt (0.01M in methanol). After 15 minutes of sonification, 0.05 g of p-fluorobenzoyl-leuco-Basic Blue 3, in a minimum volume of toluene, and 0.05 ml phthalic acid (0.4M in methanol) were added. The solutions were knife coated 0.003 inch (0.076 mm) wet on the white-pigmented film base of Examples 1–4, and dried for 2 minutes at 80° C.

Strips of the coatings prepared in this manner were exposed through a step tablet for 2 seconds on the microfiche duplicator of Examples 1–4 and developed for 8 seconds at 135° C. Reflection densitometry of the resulting cyan images yielded the sensitometric responses presented in Table VII. These data show (a) that a variety of counterions for the organoborate anion may be used in the practice of the invention, and (b) that substituted aromatic or ethynyl moieties may be incorporated into the organoborate anion.

Results with the p-tolyl substituted salt also suggest that electron releasing (donating) groups on the aryl moieties enhance the photosensitivity of the resulting imaging material. By contrast, attempted formulation of a photothermographic medium comprising lithium tetrakis-(3,5-bis-trifluoromethylphenyl)borate as the organoborate component failed to yield a light sensitive coating.

TABLE VII

Sensitometry of Photothermographic Imaging Media.

| Organoborate Salt. | $D_{min}$ | $D_{max}$ | Speed (step no.) |
|---|---|---|---|
| Sodium tetraphenylborate | 0.17 | 1.89 | 10 |
| Lithium triphenyl-(p-tolyl)borate (a) | 0.28 | 2.20 | 16 |
| Potassium triphenyl-(p-phenylethynyl)borate (b). | 0.26 | 2.00 | 12 |

(a) Prepared by following the general procedure of Wittig and Herwig, Chem. Ber. 88, 962 (1955).
(b) Prepared as described by Kropp et al., JACS 113, 2155 (1991).

EXAMPLE 8

Portions (6.5 g) of the silver behenate pre-mix of Example 1 were treated with 0.25 ml of 0.01M solutions (methanol) of the organoborate salts of Table VIII. After 15 min. mixing 0.25 ml 0.005M sensitizing dye MSD-2 and 50 mg p-fluorobenzoyl-leuco-Basic Blue 3 (predissolved in 1 ml 2:1 toluene-MEK) were added. Subsequent handling of the samples and coatings derived therefrom was carried out under red (Wratten 1A) safelight. Immediately before coating 3 mil wet on pigmented polyester film base using a knife coater, 0.5 ml 0.4M phthalic acid in methanol was added to each aliquot. The coated films were dried 2 min. in an oven at 80° C. Sensitometric evaluation of the coatings to yield the results reported in Table VIII was carried out as described in Example 3, except that the development temperature was 285° F.

Reversible electrochemical oxidation potentials for the organoborate anions were not directly accessible by usual means owing to instability of the free radicals produced on one-electron oxidation of the anions. Chatterjee and co-workers (*J. Amer. Chem. Soc.* 112:6329 (1990)) developed a procedure for estimating oxidation potentials under such conditions by measuring the rate of quenching of the fluorescence of an aromatic hydrocarbon in solution. We accordingly determined the oxidation potentials ($E_{ox}$) of Table VIII from the rates of their quenching of naphthalene fluorescence in ethanol solution; data analysis followed the procedure of Legros et al. (*J. Phys. Chem.* 95:4752 (1991)). These data show a rough inverse correlation between oxidation potential of the organoborate anion and photographic speed of the photothermographic film.

TABLE VIII

Sensitometric responses of photothermographic media incorporating various organoborate salts.

| Organoborate Salt | $D_{min}$ | $D_{max}$ | Speed (step no.) | gamma | $E_{ox}$ (V vs. SCE) |
|---|---|---|---|---|---|
| Na (3,4-xylyl)$_4$B | 0.25 | 2.06 | 14 | 2.4 | 1.27 |
| Na (3,5-xylyl)$_4$B | 0.19 | 1.91 | 12 | 2.4 | 1.30 |
| Na(p-tolyl)$_4$B | 0.22 | 2.09 | 13 | 3.2 | 1.32 |
| Na (phenyl)$_4$B | 0.21 | 2.02 | 12 | 2.5 | 1.40 |
| Na [3,5-di(trifluoromethyl) phenyl]$_4$B | 0.40 | 1.95 | 12 | 2.15 | 1.41 |
| Li (phenylethynyl)$_4$B | 0.18 | 1.81 | 8 | — | .* |
| Na (p-anisyl)$_4$B | 0.25 | 2.12 | 6 | — | .* |
| $Et_4N$ butyl(phenyl)$_3$B | 0.29 | 2.10 | 7 | — | .* |

*These organoborate anions form thermally unstable silver salts and fail to yield linear Stern-Volmer plots in the fluorescence quenching experiment.

We also attempted to isolate Ag salts of the organoborate anions of Table VIII. Portions of the organoborate salt were triturated with 0.4M ethanolic Ag tetrafluoroborate (ca. 1 equivalent). The resulting crystalline products were isolated by suction filtration and air dried for the first five anions of the Table. In the latter three cases this procedure led to decomposition with formation of metallic Ag from the butyltriphenylborate and the tetrakis(p-anisyl)borate, and of phenylacetylene from the teetrakis(phenyl-ethynyl)borate anion, identified by UV spectroscopy.

This example thus provides additional illustration of the range of useful organoborate salts in the practice of the invention. Formation of thermally stable silver salts appears to be prerequisite to effective sensitometric performance of the photothermographic media.

EXAMPLE 9

The formulation of the photothermographic media of Example 8 was repeated. This time to each aliquot of the silver behenate pre-mix was added 2.5 mg AF-1 at the same time as the sensitizing dye and leuco dye developer. Coating, drying and evaluation procedures were carried out as in the previous example, with results as described in Table IX.

TABLE IX

Sensitometric responses of photothermographic media incorporating various organoborate salts and AF-1.

| Organoborate Salt | $D_{min}$ | $D_{max}$ | Speed (step. no.) | gamma |
|---|---|---|---|---|
| Na (3,4-xylyl)$_4$B | 0.21 | 1.98 | 8 | 2.2 |
| Na (3,5-xylyl)$_4$B | 0.17 | 1.97 | 9 | 1.95 |
| Na (p-tolyl)$_4$B | 0.18 | 1.93 | 9 | 2.5 |
| Na (phenyl)$_4$B | 0.17 | 1.82 | 7 | 1.95 |
| Na [3,5-di(trifluoromethyl) phenyl]$_4$B | 0.37 | 2.05 | 10 | 2.15 |
| Li (phenylethynyl)$_4$B | 0.16 | 1.68 | 5 | — |
| Na (p-anisyl)$_4$B | 0.26 | 2.12 | 6 | — |
| Et$_4$N butyl(phenyl)$_3$B | 0.29 | 2.10 | 8 | — |

Those skilled in the art might anticipate that incorporation of an organobromine compound, e.g. AF-1, in a silver salt containing formulation might lead, in part, to conversion of the organo-bromine compound to AgBr, the data of this example show that any AgBr, if so formed, does not contribute to the photosensitivity of the constructions. On the contrary, incorporation of AF-1 leads consistently to losses of photographic speed (cf. Tables VIII and IX), which is typical of incorporation of antifoggant compounds in conventional silver photographic media.

EXAMPLE 10

A standard test formulation comprised:

| | |
|---|---|
| Ag Behenate (Full soap) | 10 g |
| 2-butanone | 5 g |
| methanol | 5 g |
| Cellulose acetate butyrate | 1 g |
| Antifoggant as noted below | |
| Sensitizing dye as noted below | |

The mixture was made under green safelight and ball-milled for 4 hours at room temperature; it was then knife coated 4 mils wet onto unsubbed polyester film base and dried 3 minutes at 80° C. It was overcoated with a mixture comprising:

| | |
|---|---|
| Cellulose acetate butyrate | 2 g |
| CAO-5 | 0.6 g |
| Phthalazinone | 0.2 g |
| 2-butanone | 10 g |
| methanol | 10 g |

The second trip was also applied 4 mils wet under green safelight and the resulting construction dried an additional 3 minutes at 80° C.

Sensitizing dyes were selected from the following:

SD-2

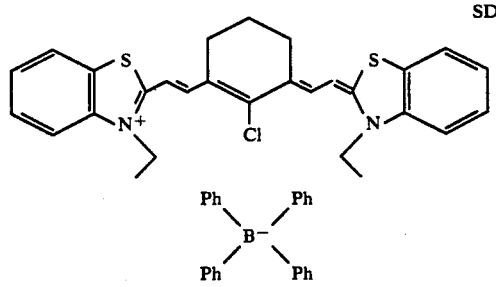

SD-3

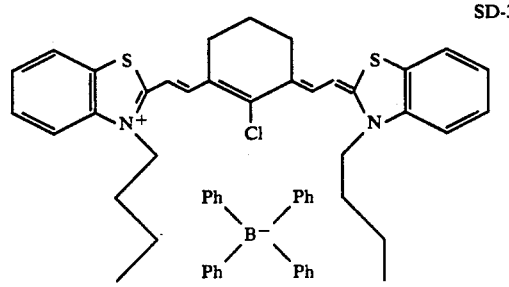

SD-4

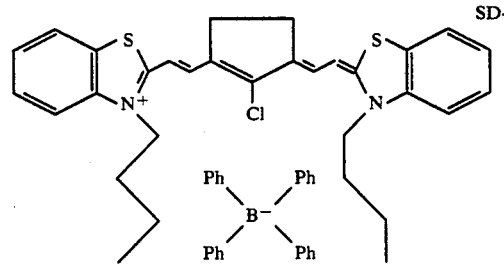

Organoborate salts of each of these cyanine dyes were prepared from the corresponding iodide salts, obtained in the usual way, by taking a solution thereof (0.0015 mol) in hot ethanol (1.51 l) and dimethylformamide (100 ml) and treating with a solution of sodium tetraphenylborate (0.60 g, 0.0017 mol), also in ethanol (20 ml). The resulting mixtures were stirred thoroughly and allowed to cool overnight; they were filtered to obtain crystals of the organoborate salt of the cyanine dyes, which were washed three times with ethanol (50 ml) and air dried. Utility of these dyes was illustrated by representative results obtained on comparison of SD-2 as its iodide and tetraphenylborate salts in Table X.

Coatings were image-wise exposed with a 100 mwatt laser diode emitting at 830 nm and subsequently developed 10 sec at 120° C. $D_{max}$ represents the transmission optical density of the silver image obtained in exposed regions of the coating, while $D_{min}$ corresponds to unexposed regions. Wedge spectrograms demonstrated a maximum in response at 450 nm when antifoggant AF-3 was employed, indicating that AgBr had formed in situ from interaction of this reagent with Ag behenate. There was no evidence of similar AgBr formation from AF-1.

TABLE X

Densitometric responses of coatings of Example 10.

| Experiment | Sensitizing Dye | Antifoggant | $D_{min}$ | $D_{max}$ |
|---|---|---|---|---|
| 10-1 | SD-2 Ph$_4$B (0.125 g) | AF-3 (0.05 g)* | 0.28 | 0.66 |
| 10-2 | Sd-2 I (0.125 g) | AF-3 (0.05 g)* | 0.29 | 1.07 |
| 10-3 | SD-2 Ph$_4$B | AF-1 | 0.13 | 1.68 |

TABLE X-continued

Densitometric responses of coatings of Example 10.

| Experiment | Sensitizing Dye | Antifoggant | $D_{min}$ | $D_{max}$ |
|---|---|---|---|---|
| | (0.006 g) | (0.0125 g) | | |
| 10-4 | SD-2 I | AF-1 | 0.12 | 1.72 |
| | (0.006 g) | (0.0125 g) | | |
| 10-5 | SD-2 $Ph_4B$ | $Hg(OAc)_2$ | 0.13 | 1.81 |
| | (0.006 g) | (0.01 g) | | |
| 10-6 | SD-2 I | $Hg(OAc)_2$ | 0.11 | 1.96 |
| | (0.006 g) | (0.01 g) | | |

*AF-3 is 2-(tribromomethylsulfonyl)-benzothiazole.

This example teaches utility of introducing the tetrahydrocarbylborate anion as the counterion of a cationic sensitizing dye. Data of Table X demonstrate that at least comparable sensitometric results may be obtained following the teaching of the invention (experiments 10-3 and 10-5) to those obtained with silver halide containing constructions (experiments 10-1, 10-2, 10-4, and 10-6).

What is claimed is:

1. A composition for photothermographic imaging comprising a source of reducible silver ions, a reducing agent capable of reducing said source of silver ions, and a polymeric binder, said source comprising a silver salt of a long chain orgainic acid and a metathetical reaction product of said salt of a long chain organic acid with a salt containing an organoborate anion.

2. A composition as recited in claim 1 wherein said salt containing an organoborate anion has the general structure

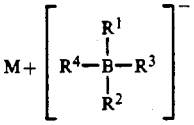

in which;

$R^1$, $R^2$, $R^3$, and $R^4$ independently represent a halogen atom, a cyano group, an alkyl group comprising up to 30 carbon atoms, an alkenyl group comprising up to 30 carbon atoms, an alkynyl group comprising up to 30 carbon atoms, an aryl group comprising up to 14 carbon atoms, an aralkyl group comprising up to 14 carbon atoms, an alkoxy group comprising up to 30 carbon atoms; an aryloxy group comprising up to 14 carbon atoms, a carbocyclic ring nucleus, a carbocyclic fused ring nucleus, a heterocyclic ring nucleus, a heterocyclic fused ring nucleus, which ring atoms of both the heterocyclic ring nucleus and the heterocyclic fused ring nucleus are selected from C, N, O, S and Se ring atoms; and $M^+$ is a cation.

3. A composition as recited in claim 2 wherein at least three of said $R^1$, $R^2$, $R^3$, and $R^4$ independently represent an aryl group comprising up to 14 carbon atoms.

4. A composition as recited in claim 1 wherein said long chain organic acid is chosen from the group having a backbone containing between 10 and 30 carbon atoms.

5. A composition as recited in claim 1 wherein said reducing agent is chosen from the group consisting of leuco dyes, phenidone, hydroquinones, catechol, and sterically hindered phenolic compounds.

6. A composition as recited in claim 5 wherein said reducing agent is chosen from the leuco dyes having the general structure,

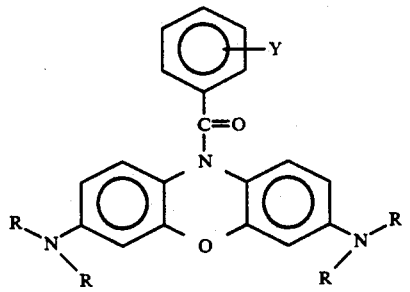

where

R represents substituents independently selected from alkyl group,

Y is one or more substituents of the ring chosen from alkyl, alkoxy, hydroxy, halogen, and thioalkyls.

7. A composition as recited in claim 6 wherein said leuco dye is chosen from

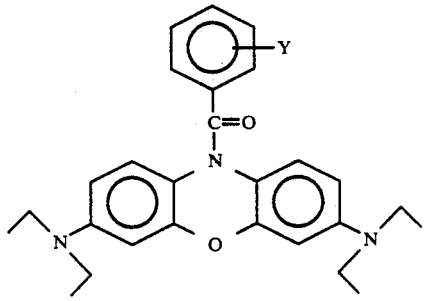

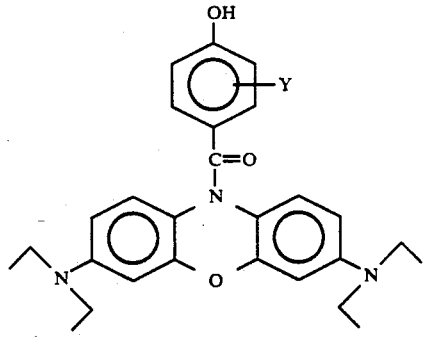

8. A composition as recited in claim 1 wherein said binder is chosen from the group consisting of gelatin, gum arabic, poly(vinyl alcohol), hydroxyethyl cellulose, cellulose acetate, cellulose acetate butyrate, poly(vinyl pyrrolidine), casein, starch, poly(acrylate), poly(methylmethacrylate), poly(vinyl chloride), poly(methacrylate), poly(styrene-maleic anhydride), poly(styrene-acrylonitrile), poly(styrenebutadiene), poly(vinyl acetals), poly(vinyl formal), poly(vinyl butyral), poly(esters), poly(urethanes), phenoxy resins, poly(vinylidene chloride), poly(epoxides), poly(carbonates), poly(vinyl acetate), cellulose esters, and poly(amides).

9. A composition as recited in claim 1 further comprising a toner selected from phthalazinone, phthalic acid, and a combination of both phthalazine and phthalic acid.

10. A composition as recited in claim 1 further comprising a spectral sensitizing dye.

11. A photothermographic sheet comprising a substrate and at least one layer coated on at least one side of it, said layer comprising a composition as claimed in claim 1.

12. A photothermographic sheet as recited in claim 11 wherein said substrate is selected from the group consisting of paper, polyethylene-coated paper, polypropylene-coated paper, parchment, cloth, sheets and foils of metals, glass, and glass coated with metals.

13. A composition for photothermographic imaging comprising a source of reducible silver ions, a reducing agent capable of reducing said source of silver ions, and a polymeric binder, said source comprising a silver salt of a long chain organic acid, and an organoborate anion.

* * * * *

UNITED STATES PATENT AND TRADEMARK OFFICE

CERTIFICATE OF CORRECTION

PATENT NO. : 5,260,180
DATED : November 9, 1993
INVENTOR(S) : Melville R. V. Sabyun, et. al.

It is certified that error appears in the above-indentified patent and that said Letters Patent is hereby corrected as shown below:

On the Title page, item [75], inventor: add "Ramaiah R. Muthyala, Mendota Heights, Minn".

Signed and Sealed this

Seventh Day of June, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,260,180

DATED : November 9, 1993

INVENTOR(S) : Sahyun et al.

It is certified that error appears in the above-indentified patent and that said Letters Patent is hereby corrected as shown below:

Column 3, line 56, delete "$Ag^+$, $Cd^{2+}$, $Cu^+$, $Pb^+$, $Pb^{2+}$, $Sn^{2+}$, $Zn^{2+}$," and insert --$Ag^+$, $Cd^{2+}$, $Cu^+$, $Cu^{2+}$, $Pb^+$, $Pb^{2+}$, $Sn^{2+}$, $Zn^{2+}$,--.

Column 11, line 41, delete "381-20".

Column 11, line 52, delete "381-20".

Signed and Sealed this

Seventeenth Day of January, 1995

*Attest:*

*Attesting Officer*

BRUCE LEHMAN

*Commissioner of Patents and Trademarks*